US008424998B2

(12) United States Patent
Smink

(10) Patent No.: US 8,424,998 B2
(45) Date of Patent: Apr. 23, 2013

(54) METHOD FOR ALIGNING A PLURALITY OF ELEMENTS AND A DEVICE COMPRISING A PLURALITY OF ELEMENTS

(75) Inventor: Olav G. Smink, Helmond (NL)

(73) Assignee: Oce-Technologies B.V., Venlo (NL)

( * ) Notice: Subject to any disclaimer, the term of this patent is extended or adjusted under 35 U.S.C. 154(b) by 226 days.

(21) Appl. No.: 13/109,656

(22) Filed: May 17, 2011

(65) Prior Publication Data

US 2011/0234666 A1 Sep. 29, 2011

Related U.S. Application Data

(63) Continuation of application No. PCT/EP2009/064582, filed on Nov. 4, 2009.

(30) Foreign Application Priority Data

Nov. 17, 2008 (EP) ..... 08169237

(51) Int. Cl.
*B41J 29/393* (2006.01)

(52) U.S. Cl.
USPC ..... 347/19

(58) Field of Classification Search ..... 347/19
See application file for complete search history.

(56) References Cited

U.S. PATENT DOCUMENTS 4,675,696 A * 6/1987 Suzuki ..... 347/19
6,467,867 B1 * 10/2002 Worthington et al. ..... 347/19
7,688,488 B2 * 3/2010 Kobayashi ..... 358/514
2004/0196325 A1 10/2004 Castano et al.
2005/0206980 A1 9/2005 Nishikawa et al.

FOREIGN PATENT DOCUMENTS

GB 2358947 A 8/2001

OTHER PUBLICATIONS

PCT/ISA/237—Written Opinion dated Jan. 3, 2010, PCT/EP2009/064582.

* cited by examiner

*Primary Examiner* — Julian Huffman
(74) *Attorney, Agent, or Firm* — Birch, Stewart, Kolasch & Birch, LLP

(57) ABSTRACT

The invention relates to a method for aligning a plurality of elements with each other, each element having a position and a positioning range, the method comprising the steps of determining the position of each element, determining the positioning range of each element, determining a common positioning range of the plurality of elements, based on the positioning ranges determined in the previous step, the common positioning range being comprised in each positioning range, establishing a reference position lying within the common positioning range and aligning the plurality of elements with the reference position. The invention also comprises a device suitable to apply the method according to the invention.

9 Claims, 7 Drawing Sheets

METHOD FOR ALIGNING A PLURALITY OF ELEMENTS AND A DEVICE COMPRISING A PLURALITY OF ELEMENTS

CROSS REFERENCE TO RELATED APPLICATIONS

This application is a Continuation of PCT International Application No. PCT/EP2009/064582 filed on Nov. 4, 2009, which claims priority of Application No. 08169237.8 filed in the European Patent Office on Nov. 17, 2008, all of which are hereby expressly incorporated by reference into the present application.

The invention relates to a method for aligning a plurality of elements with each other, each element having a position and a positioning range. The method comprises the step of determining the position of each element and aligning the plurality of elements with a reference position.

From a known printing apparatus aligning of a plurality of elements is known. In the known printing apparatus aligning is performed by determining the position of each element of the plurality of elements, selecting an element of the plurality of elements which is suitable for acting as a reference element for the other elements and taking the selected element as the reference element. Then elements of the plurality of elements other than the reference element are repositioned such that they become aligned with the position of the reference element.

A method of this kind is known from US 2005/0206980. In an image forming apparatus for forming a color image a control device obtains position data representing a forming position of each of plural registration mark images for each component color with respect to a positional reference value. For example, the position of color registration marks for the color black are taken as the reference position. A disadvantage of this known method is that always the same reference position is used. This makes the method less flexible or even useless when another element than the element which sees to the color registration marks for the color black cannot reach the used reference position any more.

In general, an element other than the reference element may be limited in the positions that can be reached by the element. Moreover, an element may have such a limited positioning range that the element can not be aligned with the position of the reference element. A limitation of a positioning range may occur if the element is not displaceable into a position in which the element is in alignment with the position of the reference element.

An object of the present invention is to provide a method for aligning elements in which at least one of the elements is limited in its positioning range.

The object is achieved in a method of the above-mentioned kind, characterized in that the method comprises the further steps of determining the positioning range of each element, determining a common range of the plurality of elements based on the determined positioning ranges, the common positioning range being comprised in each positioning range and establishing a reference position lying within the common positioning range.

By determining the positioning range of each element the possible positions for the element become known. By determining the positioning range of each element, a common positioning range may be determined based on the positioning ranges of the elements. The selection of the common positioning range is based on the ability of each element to align to each position within the common positioning range. Therefore each position within the common positioning range may be established as a reference position. In general, when a plurality of elements are in alignment with each other, the positioning ranges of the elements have an approximately equal size. In the case that each element has approximately the same positioning range, each position within the same positioning range may be established as the reference position. In practice, during the life-time of an element, the element may become limited in its positioning range. Due to a limitation of the positioning range of an element, the common positioning range may also become limited. Moreover, the common positioning range comprises only those alignment positions which can be reached by each element. For example in the case that an element is prohibited to be moved, i.e. the element has a fixed position, the common positioning range may only contain the position of the fixed element.

Each position lying within the common positioning range may be established and taken as the reference position. By establishing the reference position in such manner, each element is able to be aligned with the reference position.

The last step of the method is the alignment of the elements with the reference position. An advantage is that, despite the fact that one or more elements are limited in their positioning ranges, no element needs to be replaced with a new, well-functioning element. Applying the method will result in increasing the average life-time of an element and in lower replacement costs.

If no element has a position in the common positioning range, all elements need to be moved towards a reference position established from the positions in the common positioning range.

Aligning of an element to the other elements as used herein includes repositioning the element in such a way that the position of the element after repositioning is in a predetermined relative position to the other elements. Such relative positions of the elements are determined in such a way that an optimal or best suitable way of functioning of the elements is assured. The elements may be positioned relative to a paper path in a printer, in the neighborhood of which the elements are positioned and thereby also relative to each other. The paper path may be represented by a curve that may be a (fictive) straight line, having an arbitrary direction in a two- or three-dimensional space, which may be drawn through the elements according to a selected criterion. The curve may as well be composed of a number of straight line elements positioned under an angle with respect to each other. Further, the curve may be a smooth curve or it may not be smooth. It may be a bend curve or it may be a straight curve. In general, no limitations are to be imposed on the fictive curve. The curve is presented herein in order to illustrate and elucidate the present invention in its full scope and usability. Aligning of elements may be established by (re)positioning according to the criterion that a center of gravity, an outer surface, a corner, or any other suitable geometric feature of each element lies at the curve or at a predetermined distance from the curve. For example, if each element possesses a particular center, aligning of the elements may be established according to the criterion that the centers of the elements are (re)positioned corresponding to the curve. Another example of aligning elements which have a front side is that the front side of the elements lay on a predetermined distance from the curve after repositioning of the elements. It is noted that the elements may need to be repositioned in such a way that the elements have a same orientation, or at least any predetermined orientation, in a two- or three-dimensional space. Of course, any another criterion may be selected for suitably repositioning the elements relative to each other for aligning the elements.

In an embodiment of the method according to the invention the elements are elements of an image forming apparatus such as an electro-graphical printer, an inkjet printer or a scanner. In an image forming apparatus alignment of elements plays an important role in reliable printing of an image on a receiving medium or scanning an original document into a digital image. When an element gets limited in its positioning range or even stuck into a fixed position, the method described above may be used to establish the position of the element as a reference position. Each element may be aligned with the reference position. An advantage is that no element needs to be replaced and the printer can go on with its functions, like printing, scanning and copying. Therefore, applying the method, results in a relative high productivity. Also printer maintenance is suitable to be scheduled in the case that an element becomes limited in its positioning range. A further advantage is that the average life-time of an element of the plurality of elements may increase.

In an embodiment of the method according to the invention the method is only applied after trying to align the elements with another method which is known from the prior art. When such another method is failing, the method according to the invention may be used in order to try to get the elements finally aligned.

In an embodiment of the method according to the invention the elements are elements of an image forming apparatus. The elements are selected from a group comprising a drum, an actuator, a camera and a print head, in particular an inkjet print head. A plurality of actuators may be aligned along a straight line situated within the image forming apparatus, such as a paper path of the image forming apparatus. A plurality of cameras may be aligned along a paper path within a printer or along a carriage in a page-wide scanner. A plurality of print heads may be aligned on a print head carriage of an inkjet printer or electro-graphical printer. A combination of different kind of elements may also be aligned, for example one or more cameras and one or more print heads.

The invention also comprises a device comprising a plurality of elements, a position determining means configured to determine a position of each of the plurality of elements, a positioning range determining means configured to determine a positioning range of each of the plurality of elements, a common positioning range determining means configured to determine a common positioning range of the plurality of elements, which common positioning range is based on the positioning range of each of the plurality of elements, which is determined by the positioning range determining means, an establishing means arranged to establish a reference position lying within a common positioning range, which is determined by the common positioning range determining means, and an aligning means configured to align the elements with the reference position, which is established by the establishing means.

The invention will now be further explained with reference to the appended drawings showing non-limiting embodiments.

FIG. 1*a*-1*c* show schematic views of a plurality of elements to be aligned.

FIG. 2*a*-2*b* show schematic views of a plurality of drums in an electro-graphical printer to be aligned.

Figure 1A:
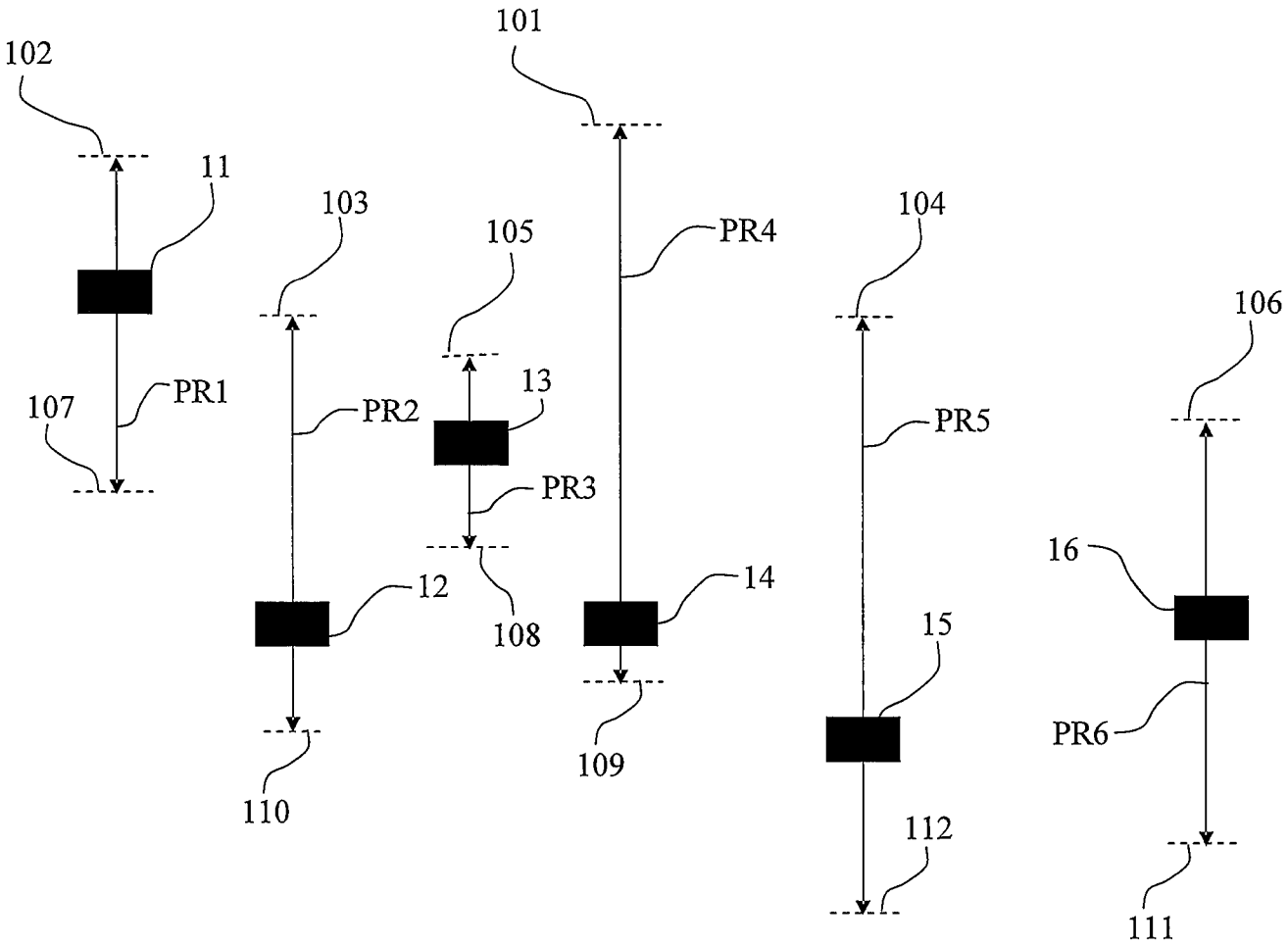

FIG. 1*a* schematically shows a view of an embodiment of a plurality of elements 11-16 to be aligned. For convenience reasons the elements 11-16 are shown in a two-dimensional space. The person skilled in the art will understand that the features of this embodiment may also be adapted to be suitable for application in a three-dimensional space.

The position of an element may be defined as a position to be determined at the borders of the element or inside the element. In the embodiment shown in FIG. 1*a* each element 11-16 is shown as a rectangle and the crossing of diagonals of the rectangle may be defined as the position of the element. Another definition of the position of an element may be, for example, a center of gravity of the element or a point of suspension of the element. Any choice of definition of position may be used in the present invention.

In general, an element in a device may be movable in a number of directions in order to alignment the element with a reference position. The positioning range of an element may be determined by moving the element from its starting point into a direction of the number of directions until the element reaches a position in which it can not be moved further in the same direction. The reached position is an end point of the positioning range. By determining the end points of the number of directions the positioning range is also determined. In general, the skilled person will be able to determine the positioning range in a manner adapted to the kind of element or to the possible movements of the element.

Figure 1B:
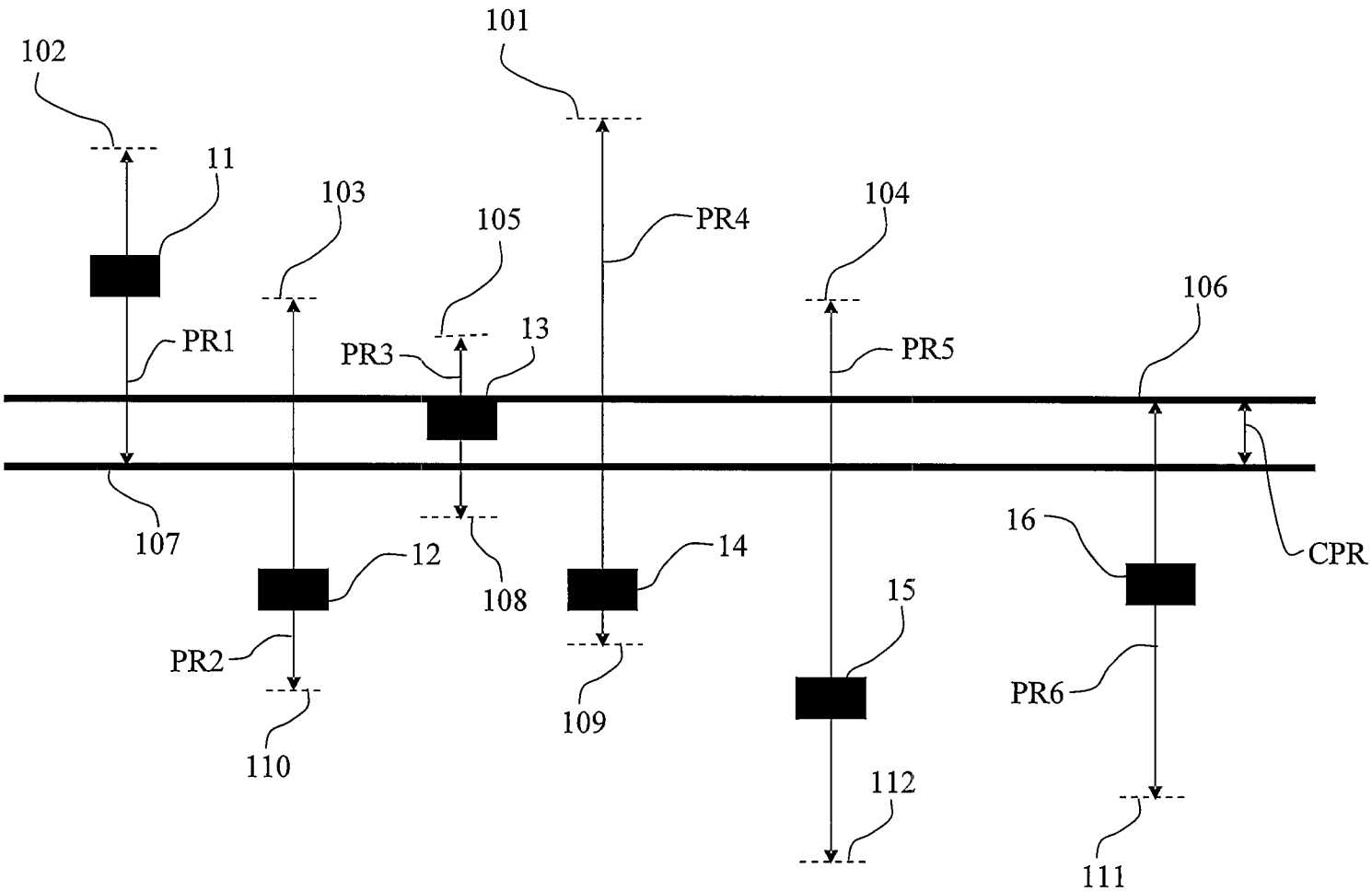
Figure 1C:
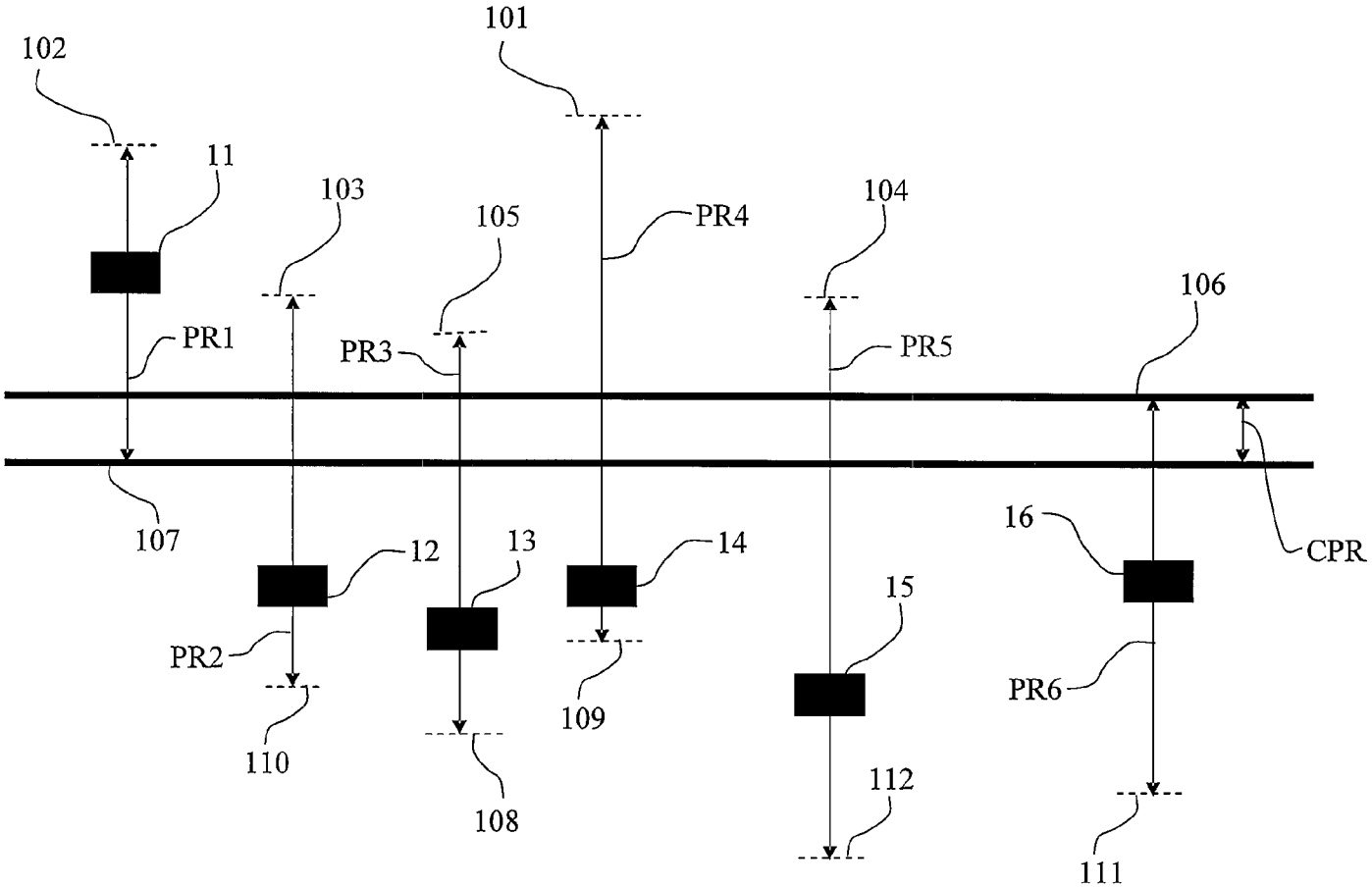

In the two-dimensional case a positioning range of an element may be represented by a line segment with two end points and is in FIG. 1*a*-1*c* indicated by a double-sided arrow. According to FIG. 1*a* a first element 11 has a first position and a first positioning range PR1. A second element 12 has a second position and a second positioning range PR2. A third element 13 has a third position and a third positioning range PR3. A fourth element 14 has a fourth position and a fourth positioning range PR4. A fifth element 15 has a fifth position and a fifth positioning range PR5. A sixth element 16 has a sixth position and a sixth positioning range PR6.

In the embodiment of FIG. 1*a* each element 11-16 is moveable into a range indicated by double-sided arrows PR1-PR6. A dashed line 101-112 in the direction of the fictive straight line determining the alignment is shown through the two end points of the positioning range of each element indicated by the double sided arrow PR1-PR6 corresponding to the element. Such an end point is a point to which a corresponding element is utmost movable. The corresponding element may also be moved to positions in between the end points in the positioning range of the corresponding element. No position outside a line segment between the two end points is reachable by the element.

With help of the dashed lines 101-112 a common positioning range may be determined. It is noted that there are several known methods to determine a common positioning range of a plurality of elements. The method explained here is one of the possible ways to determine the common positioning range. In this example we successively determine the common positioning range of the first element 11, the common positioning range of the first element 11 and the second element 12, the common positioning range of the first element 11 and the second element 12 and the third element 13, and so on. By doing so, the successively constructed common positioning ranges may become smaller to end up in a common positioning range of all elements 11-16. It is noted that by doing so each end point of the resulting common positioning range is also an end point of a positioning range of one of the elements. It is also noted that by this construction each position within the common positioning range is a position within each positioning range. A further advantage of explained method is that calculation time may be saved since the common position range is determined simultaneously with the determination of the positioning ranges of the elements.

FIG. 1*b* shows a constructed common positioning range CPR based on the situation shown in FIG. 1*a*. In this example a first line 107, being limited by an endpoint of the first positioning range PR1 of the first element 11, and a second line 106, being determined by an endpoint of the sixth positioning range PR6 of the sixth element 16, define a common positioning range CPR. It is noted that there are situations in which the end points of the common positioning range may correspond to the end points of a positioning range of a single element, for example.

The position of the third element 13 lies within the common positioning range CPR and the position of the third element 13 may be established as a reference position. The other elements 11-12, 14-16 may be aligned with the reference position of the element 13. Since the common positioning range CPR is included in the positioning range PR1-PR6 of each element 11-16, each position within the common positioning range CPR could have been established as a reference position.

In another embodiment no element is positioned within the common position range. After establishing a reference position within the common positioning range, the alignment is achieved by moving the elements towards the reference position within the common positioning range.

FIG. 1*c* shows an example in which the common positioning range CPR does not contain any element. Since the common positioning range CPR is included in the positioning range PR1-PR6 of each element 11-16, each position within the common positioning range CPR may be established as the reference position. Alignment of the elements 11-16 is being completed by moving all elements towards the reference position in the common positioning range CPR.

Several methods may be applied to determine which position within the common positioning range may be established as the reference position.

In one embodiment such a method to determine the reference position may be related to a first sum of distances of a first end point of the positioning range of each element to a first end point of the common positioning range and a second sum of distances of a second end point of the positioning range of each element to a second end point of the common positioning range. If, for example, the first sum is twice the second sum, the reference position may be established as the position within the common positioning range which lies on one-third of the size of the common positioning range from the first end point of the common positioning range and on two-third of the size of the common positioning range from the second end point of the common positioning range. Another embodiment of establishing a reference position may depend on the relation between a first number of elements which have an end point equal to a first end point of the common positioning range and a second number of elements which have an end point equal to a second end point of the common positioning range. The quotient of the first number and the second number may determine the reference position within the common positioning range. Advantage is that by alignment of the elements according to one of the two hereabove described embodiments a distance space into which the elements are moveable after alignment is relatively large compared to other embodiments or even maximized.

In another embodiment a position is established to be the reference position which satisfies a condition that sum of the distances over which the elements have to be moved towards the reference position is minimized.

In another embodiment the kind of element plays a role in determining the reference position. If, for example, a first group of elements 12, 13, 16 shown in FIG. 1*a*, are more often limited into its positioning range than a second group of elements 14, 15 shown in to FIG. 1*a*, a reference position may be established which takes this aspect into account.

Figure 2B:
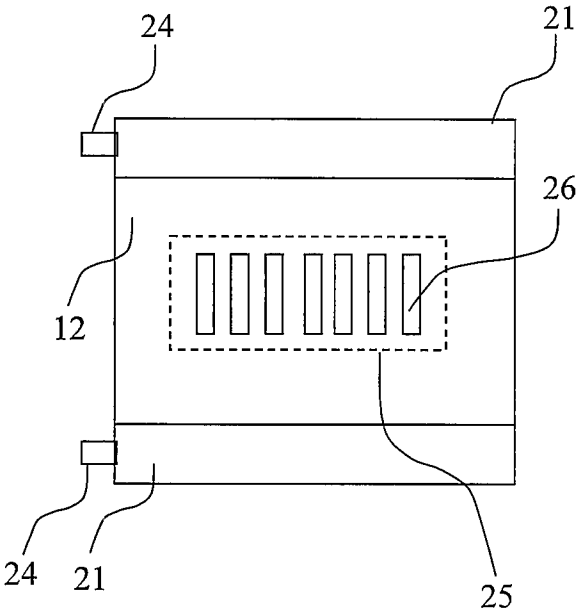
Figure 2A:
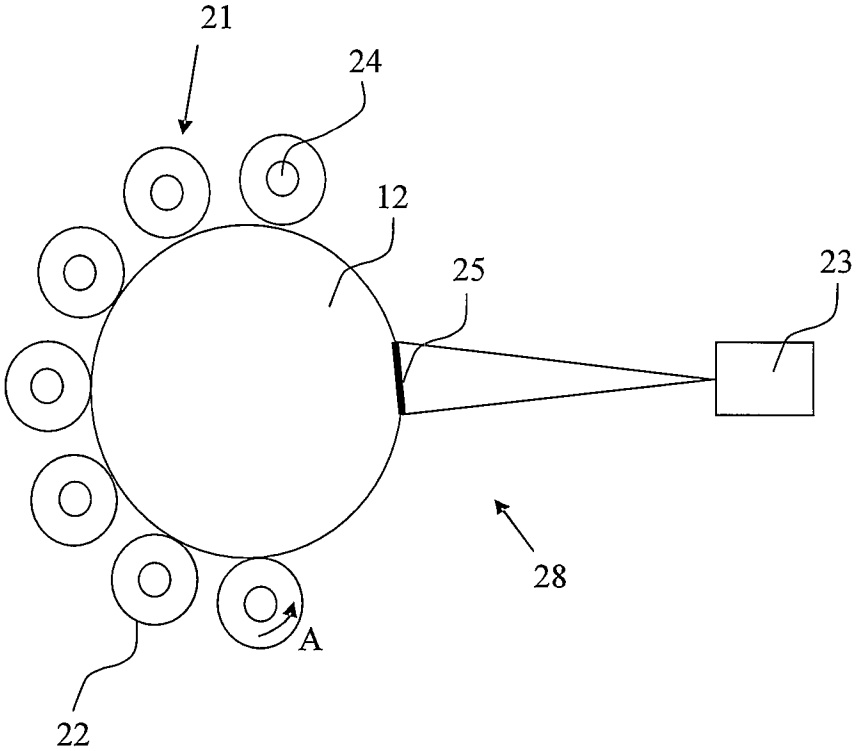

FIGS. 2*a*-2*b* schematically show a part 28 of an electrographical printer. The part 28 comprises a number of image-forming elements 21 and a transfer drum 12. Each image-forming element 21 comprises a rotation drum 22, which may be driven in the direction of the arrow A by suitable driver means (not shown), and a mechanical actuator 24 for controlling a position of the rotation drum 22 in relation to the transfer drum 12. Further the part 28 comprises a camera 23 which measures an axial registration of the rotation drums 22. To each image-forming element 21 toner with a specific color may be provided.

For printing color images, a plurality of image-forming elements 21 is used, each of said elements 21 being supplied with toner in a specific color like cyan, magenta, yellow, red, blue, green and black for forming a separation image. The part 28 further comprises a magnetic roll (not shown) and a developing unit (not shown) for each image-forming element 21 in order to develop a toner image on the image-forming element 21. The toner images of the image-forming elements 21 are transferred to the transfer drum 12 for forming a multi-color image on the transfer drum 12. The multi-color image may be printed on a receiving material (not shown). The image-forming elements 21 have to be aligned in order to get an accurate multi-color image consisting of dots of a number of colors as mentioned above. For this alignment the mechanical actuators 24 are provided, which control the axial position of the rotation drums 22. The printer is configured for determining whether one of the actuators 24 is misaligned by using the camera 23.

The alignment of the rotation drums 22 may be established in a few steps. A first step is the creation of a test image 25 on the transfer drum 12 by means of the image-forming elements 21. For each color the test image 25 comprises a rectangle 26 which comprises toner of the color. A rectangular separation image may be transferred from each image-forming element 21 towards the transfer drum 12. By doing so, a test image 25 is created on the transfer drum 12. The test image 25 comprises rectangles 26 for each color, in this case seven rectangles 26 are created. It is noted that instead of rectangles, any other suitable shape or form may be used. A second step is determining a positional relation between the rectangles 26. Distances between each two rectangles 26 may be used for the determination on behalf of a correct alignment of the rotation drums 22. The calculations include determining the positions and positioning range of each rotation drum 22 and establishing a common positioning range, based on the determined positioning ranges. To determine the positioning range of each drums 22, the drums 22 are moved by actuating the actuators 24 into a first direction until they reach their utmost position. At that time a first test image is registered by the camera 23 and saved in a memory of a control circuit (not shown) of the printer. After the registration of the first test image the drums 22 are moved by actuating the actuators 24 into a second direction opposite to the first direction until they reach their utmost position. At that time a second test image is registered by the camera 23 and saved in the memory of the control circuit of the printer. By comparing the positions on the first and second test image corresponding to the same drum 22, a positioning range of the drum 22 is determined and saved in the control memory. By mutually comparing the positioning ranges of the drums 22, a common positioning range may be determined, for example according to a method described earlier and saved in the memory of the control circuit. A reference position within the common positioning range is established and saved in the control circuit. The reference position and the positions of the drums 22 are used by the control circuit to activate the actuators 24 such that the drums 22 are moved to the established reference position. The alignment may be checked by registering an additional third test image by the camera 23.

Each position of the common positioning range may be established to become the reference position for alignment of the rotation drums 22. In the case that an actuator 24 is limited in its positioning range, the common position range is also limited by construction. It may happen that one of the actuators 24 is limited in its positioning range such that the positioning range comprises only one position. This may be caused by the fact that the actuator has broken down. In the latter case the position of the rotation drum 22 corresponding to the defect actuator 24 becomes the reference position. An advantage in the case of a positioning range limitation of an actuator 24 is that functionality of measuring and controlling of the printer may still function properly without the user to know that the printer has a problem. The printer may indicate, for example to a service-mechanic, that an actuator 24 should be replaced or repaired. Another advantage is that no immediate service call is needed.

Figure 3:
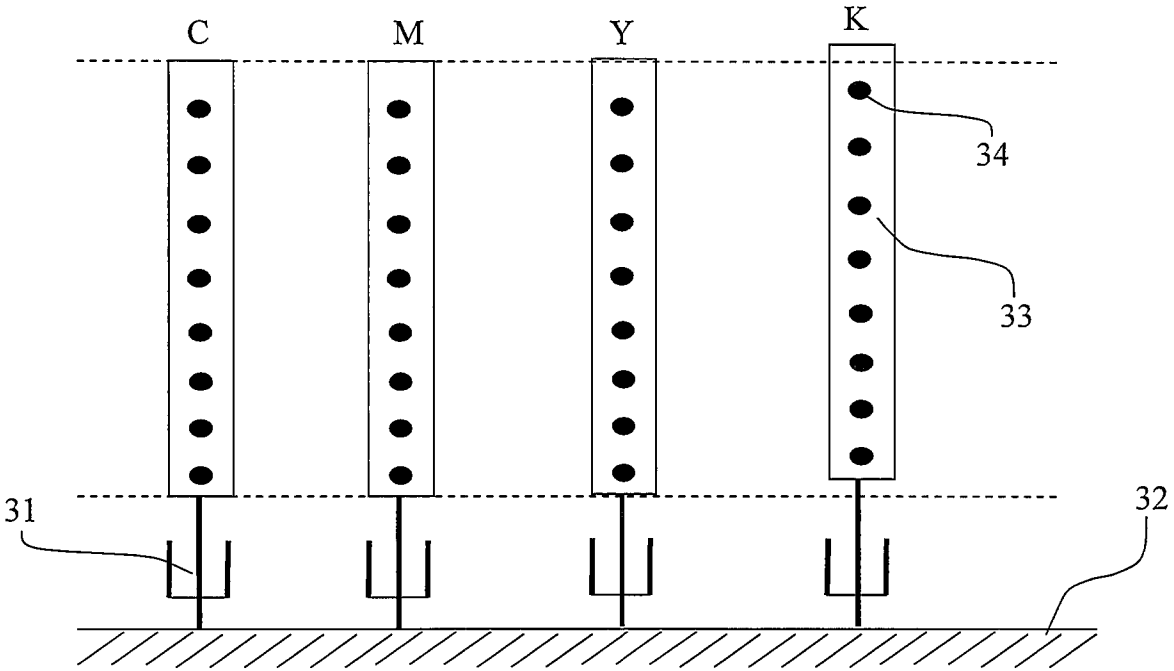
FIG. 3 shows a schematic view of a plurality of print heads in an inkjet printer to be aligned.

FIG. 3 shows a part of an inkjet printer comprising a number of print heads 33, each delivering ink of a color C, M, Y, K via a number of nozzles 34. In FIG. 3 eight nozzles 34 per print head are shown, but the skilled person readily understands that in practice the number of nozzle may be larger. Each print head 33 is coupled to an actuator 31. The actuator 31 is configured to be able to align the print head 33 with the other print heads. The actuators are positioned on a carriage 32 of the inkjet printer. By moving an actuator 31 between its utmost reachable positions a positioning range is determined. Based on the number of positioning ranges of the actuators 31 a common positioning range of the actuators 31 is calculated. Each position within the common positioning range may be established to become reference position. The reference position is used to align the actuators 31. Since each actuator 31 is coupled to a unique print head 33, the alignment of the actuators 31 automatically leads to an alignment of the print heads 33.

In another embodiment the common positioning range of the actuators may contain no position. In that case it still may be possible to position the print heads 33 in such a way that printing can proceed. The positions of the print heads 33 may be selected such that a number of nozzles 34 of each print head 33 are aligned. The aligned nozzles may take care of printing. The nozzles, which are not aligned, may not be used for printing. A possible increase of printing time of an image due to the fact that a smaller amount of nozzles are engaged may be compensated by a gain of printing time resulting from the fact that printing can still proceed. In the meanwhile the printer may indicate, for example to a service-mechanic, that an actuator 31 should be replaced or repaired, or at least that the alignment procedure was not successful.

Figure 4:
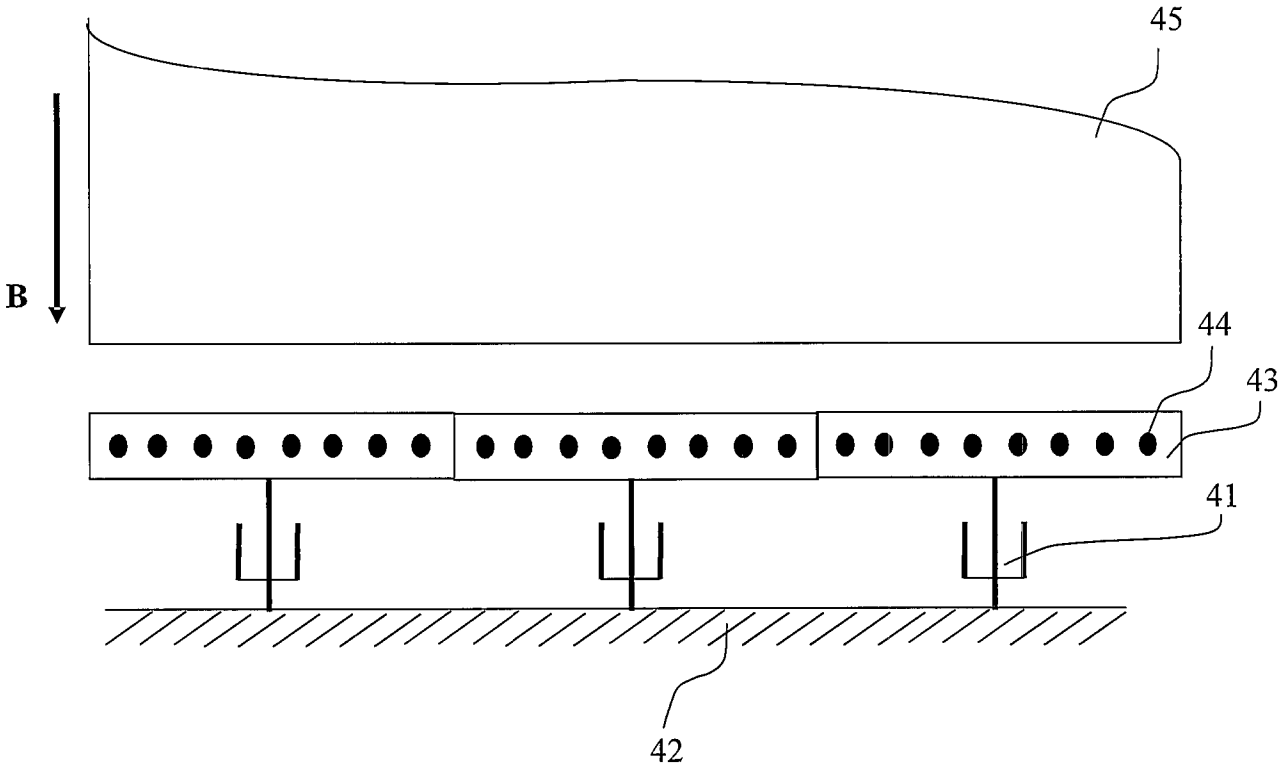
FIG. 4 shows a schematic view of a plurality of print heads in a printer to be aligned.

FIG. 4 shows a part of an inkjet printer, which comprises a number of print heads 43 which are situated on a carriage 42 and may approximately be in line with each other. Each print head comprises a number of nozzles 44. Each nozzle 44 may be able to eject ink drops on a receiving material 45. Each print head 43 is coupled to an actuator 41. Each actuator 41 is configured to be able to align the corresponding print head 43 with the other print heads. For convenience reasons only 3 print heads are shown in FIG. 4, but the skilled person understands that in practice the number of print heads may be other than 3. The receiving material 45 is moved in the direction of a directed arrow B towards the print heads 43 in order to form an image of ink drops, which are ejected from the nozzles 44 of the print heads 43. The method according to the invention may be applied in order to align the actuators 41 and at the same time the print heads 43. By applying the method e.g. a straight line emerges on the receiving material 45 if all nozzles 44 eject an ink drop simultaneously. In another embodiment the receiving material 45 is lying on a plate and the carriage 42 is moving over the receiving material 45 in order to eject ink drops via the nozzles 44 of the print heads 43.

Figure 5:
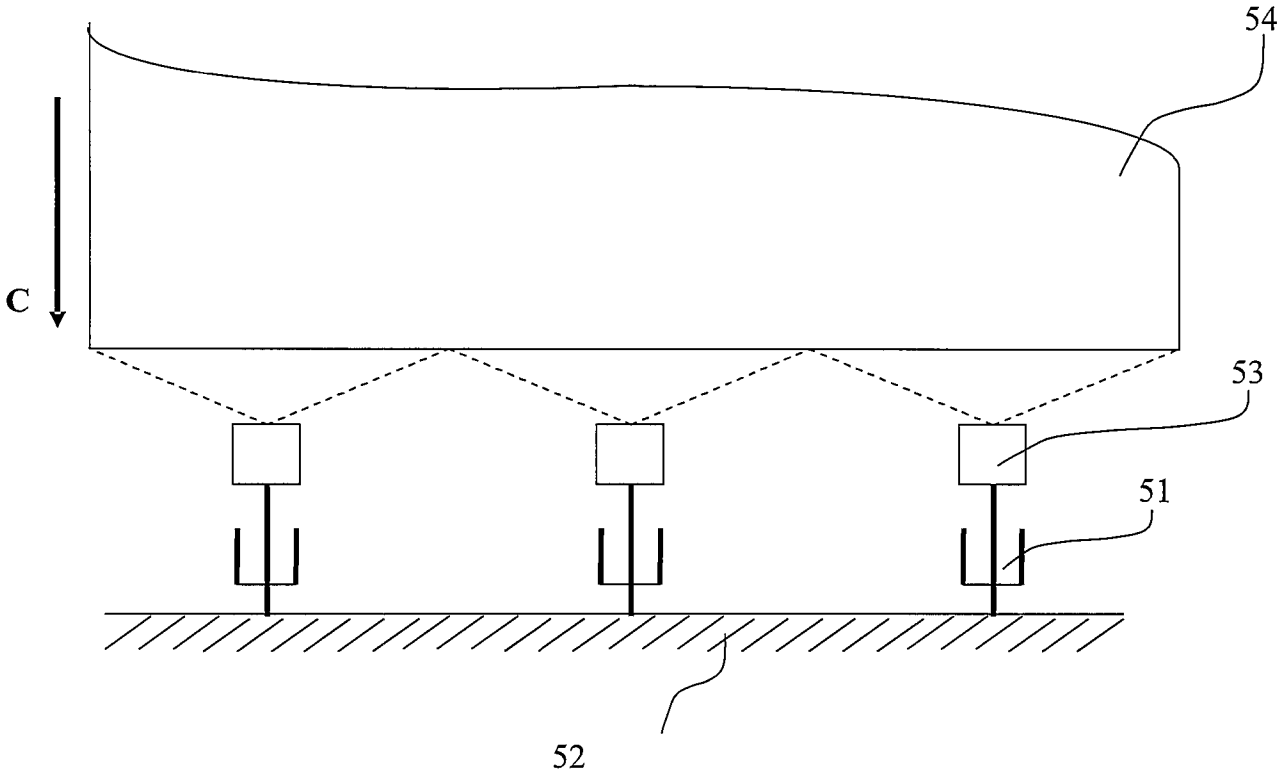
FIG. 5 shows a schematic view of a plurality of cameras in a scanner to be aligned.

FIG. 5 shows a part of a scanner, which comprises a number of cameras 53 which are situated on a carriage 52 and are being in line with each other. Each camera 53 is coupled to an actuator 51. Each actuator 51 is configured to be able to align the camera 53 with the other cameras. For convenience reasons only 3 cameras are shown in FIG. 5, but the skilled person understands that in practice the number of cameras may be other than 3. An original image printed on a receiving material 54 like paper or sheet or any other kind of receiving material is to be scanned by the cameras 53. The original image printed on the receiving material 54 is moved in the direction of a directed arrow C towards the cameras in order to form a digital image of the original image printed on the receiving material 53. A part of the original image may be perceived by each one of the cameras 53. By combining such parts a digital image representing the original image on the receiving material 54 may be created. In order to get a correct digital image it may be important that the cameras 53 are aligned.

The method according to the invention may be applied in order to align the cameras 53. In another embodiment the receiving material 54 is lying on a plate and the carriage 52 is moving over the receiving material 54 in order to perceive an image via the cameras 53 situated on the carriage 52.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention claimed is:

1. Method for aligning a plurality of elements with each other, each element having a position and a positioning range, the method comprising the steps of a) determining the position of each element, b) aligning the plurality of elements with a reference position, wherein the method further comprises the steps of c) determining the positioning range of each element, d) determining a common positioning range of the plurality of elements, based on the positioning ranges determined in step c), the common positioning range being comprised in each positioning range, and e) establishing a reference position lying within the common positioning range.

2. Method according to claim 1, wherein the elements are imaging elements of a printer or scanner.

3. Method according to claim 1, wherein each element is selected from a group of elements comprising an actuator, a camera and a print head, the print head in particular being an inkjet print head.

4. Method according to claim 1, wherein the reference position is selected from the positions determined in step a).

5. Method according to claim 2, wherein the reference position is selected from the positions determined in step a).

6. Method according to claim 3, wherein the reference position is selected from the positions determined in step a).

7. Image-forming device comprising a plurality of elements, a position determining means configured to determine a position of each of the plurality of elements, a positioning range determining means configured to determine a positioning range of each of the plurality of elements, a common positioning range determining means configured to determine a common positioning range of the plurality of elements, which common positioning range is based on the positioning range of each of the plurality of elements, which is determined by the positioning range determining means, the common positioning range being comprised in each positioning range, an establishing means for establishing a reference position within the common positioning range determined by the common positioning range determining means, and a positioning means configured to position each of the plurality of elements in line with the reference position established by the establishing means.

8. Image-forming device according to claim 7, wherein the image-forming device is an inkjet printer, the plurality of elements comprising at least two inkjet print heads and the method comprising aligning the two inkjet print heads.

9. Image-forming device according to claim 8, wherein the at least two inkjet print heads are configured for ejecting droplets of ink of different colors.

* * * * *